US006186850B1

(12) United States Patent
Cathey, Jr. et al.

(10) Patent No.: US 6,186,850 B1
(45) **Date of Patent: *Feb. 13, 2001**

(54) METHOD OF PREVENTING JUNCTION LEAKAGE IN FIELD EMISSION DISPLAYS

(75) Inventors: David A. Cathey, Jr.; John Lee, both of Boise, ID (US)

(73) Assignee: Micron Technology, Inc., Boise, ID (US)

( * ) Notice: Under 35 U.S.C. 154(b), the term of this patent shall be extended for 0 days.

This patent is subject to a terminal disclaimer.

(21) Appl. No.: 09/461,917

(22) Filed: Dec. 15, 1999

Related U.S. Application Data

(63) Continuation of application No. 09/190,737, filed on Nov. 12, 1998, now Pat. No. 6,020,683, which is a continuation of application No. 08/897,240, filed on Jul. 18, 1997, now Pat. No. 5,866,979, which is a continuation of application No. 08/307,365, filed on Sep. 16, 1994, now abandoned.

(51) Int. Cl.[7] ..... H01J 9/02

(52) U.S. Cl. ..... 445/24

(58) Field of Search ..... 445/24

(56) References Cited

U.S. PATENT DOCUMENTS

| | | |
|---|---|---|
| 3,500,102 | 3/1970 | Crost et al. . |
| 3,814,968 | 6/1974 | Nathanson et al. . |
| 3,883,760 | 5/1975 | Cunningham . |
| 3,970,887 | 7/1976 | Smith et al. . |
| 4,575,765 | 3/1986 | Hirt . |
| 4,859,304 | 8/1989 | Cathey et al. . |
| 4,874,981 | 10/1989 | Spindt . |
| 4,940,916 | 7/1990 | Borel et al. . |
| 4,992,137 | 2/1991 | Cathey et al. . |
| 5,000,208 | 3/1991 | Ludwig et al. . |
| 5,024,722 | 6/1991 | Cathey . |
| 5,049,520 | 9/1991 | Cathey . |
| 5,100,355 | 3/1992 | Marcus et al. . |
| 5,141,461 | 8/1992 | Nishimura et al. . |
| 5,151,061 | 9/1992 | Sandhu . |
| 5,162,704 | 11/1992 | Kobori et al. . |
| 5,186,670 | 2/1993 | Doan et al. . |
| 5,191,217 | 3/1993 | Kane et al. . |
| 5,199,917 | 4/1993 | MacDonald et al. . |
| 5,204,581 | 4/1993 | Andreadakis et al. . |
| 5,205,770 | 4/1993 | Lowrey et al. . |
| 5,210,472 | 5/1993 | Casper et al. . |
| 5,212,426 | 5/1993 | Kane . |
| 5,219,310 | 6/1993 | Tomo et al. . |

(List continued on next page.)

FOREIGN PATENT DOCUMENTS

| | | |
|---|---|---|
| 2 139 868 | 3/1972 | (DE) . |
| 549 133 A1 | 6/1993 | (EP) . |
| 1 311 406 | 3/1973 | (GB) . |

OTHER PUBLICATIONS

Martin J. Berger et al.; "Photo Attenuation Coefficients"; CRC Handbook of Chemistry and Physics; pp. 10–284 and 10–287.

(List continued on next page.)

*Primary Examiner*—Kenneth J. Ramsey
(74) *Attorney, Agent, or Firm*—Trask Britt

(57) ABSTRACT

A method for fabricating a field emission display (FED) with improved junction leakage characteristics is provided. The method includes the formation of a light blocking element between a cathodoluminescent display screen of the FED and semiconductor junctions formed on a baseplate of the FED. The light blocking element protects the junctions from light formed at the display screen and light generated in the environment striking the junctions. Electrical characteristics of the junctions thus remain constant and junction leakage is improved. The light blocking element may be formed as an opaque light absorbing or light reflecting layer. In addition, the light blocking element may be patterned to protect predetermined areas of the baseplate and may provide other circuit functions such as an interconnect layer.

14 Claims, 1 Drawing Sheet

U.S. PATENT DOCUMENTS

| | | |
|---|---|---|
| 5,229,331 | 7/1993 | Doan et al. . |
| 5,229,682 | 7/1993 | Komatsu . |
| 5,232,549 | 8/1993 | Cathey et al. . |
| 5,259,799 | 11/1993 | Doan et al. . |
| 5,283,500 | 2/1994 | Kochanski . |
| 5,329,207 | 7/1994 | Cathey et al. . |
| 5,342,477 | 8/1994 | Cathey . |
| 5,358,599 | 10/1994 | Cathey et al. . |
| 5,358,601 | 10/1994 | Cathey . |
| 5,358,908 | 10/1994 | Reinberg et al. . |
| 5,372,973 | 12/1994 | Doan et al. . |
| 5,374,868 | 12/1994 | Tjaden et al. . |
| 5,391,259 | 2/1995 | Cathey et al. . |
| 5,448,133 | 9/1995 | Ise . |
| 5,451,830 | 9/1995 | Huang . |
| 5,483,118 | 1/1996 | Nakamoto et al. . |
| 5,500,750 | 3/1996 | Kanbe et al. . |
| 5,620,832 | 4/1997 | Sung et al. . |
| 5,621,272 | 4/1997 | Levine et al. . |
| 5,632,664 | 5/1997 | Scoggan et al. . |
| 5,633,560 | 5/1997 | Huang . |
| 5,638,023 | 6/1997 | Itoh et al. . |
| 5,643,033 | 7/1997 | Gnade et al. . |
| 5,643,817 | 7/1997 | Kim et al. . |
| 5,648,698 | 7/1997 | Makishima et al. . |
| 5,648,699 | 7/1997 | Jin et al. . |

OTHER PUBLICATIONS

S.M. Sze; "Phonon Spectra and Optical, Thermal, and High–Field Properties of Semiconductors"; Physics of Semiconductor Devices; pp. 38–43.

R. Meyer; "6" Diagonal Microtips Fluorescent Display for T.V. Applications"; pp. 374–377.

Micron Display Technology, Inc., Micron Technology, Inc., Rev. 2: Oct. 26, 1992.

"The Flat Panel Display Market", Electronic Trend Publications, 1991.

The Cathode–Ray Tube, Technology, History, and Applications, Peter A. Keller, 1991.

"Physics of Semiconductor Devices", S.M. Sze., Bell Laboratories, Inc., 1981.

"Vacuum Microelectronics", Heinz H. Busta, Journal of Micronmechanics and Microengineering, 1992.

H.B. Garg et al., "Soft X–Ray Absorption in the Bulk," X–Ray Absorption in Bulk and Surfaces, Aug. 18–20, 1992, pp. 123–141.

*Elements of Physics,* A. Smith et al., McGraw–Hill, pp. 618–620.

*The Photonics Dictionary™,* p. D–125.

METHOD OF PREVENTING JUNCTION LEAKAGE IN FIELD EMISSION DISPLAYS

CROSS REFERENCE TO RELATED APPLICATION

This application is a continuation of application Ser. No. 09/190,737, filed Nov. 12, 1998, now U.S. Pat. No. 6,020,683, which is a continuation of application Ser. No. 08/897,240, filed Jul. 18, 1997, now U.S. Pat. No. 5,866,979, issued Feb. 2, 1999, which is a continuation of application Ser. No. 08/307,365, filed Sep. 16, 1994, abandoned.

This invention was made with Government support under Contract No. DABT63-93-C-0025 awarded by Advanced Research Projects Agency (ARPA). The Government has certain rights in this invention.

BACKGROUND OF THE INVENTION

1. Field of the Invention

This invention relates generally to field emission displays (FEDs) and, more particularly, to a method for preventing junction leakage in FEDs.

2. State of the Art

Flat panel displays have recently been developed for visually displaying information generated by computers and other electronic devices. Typically, these displays are lighter and utilize less power than conventional cathode ray tube displays. One type of flat panel display is known as a cold cathode field emission display (FED).

A cold cathode FED uses electron emissions to illuminate a cathodoluminescent screen and generate a visual image. An individual field emission cell typically includes one or more emitter sites formed on a baseplate. The baseplate typically contains the active semiconductor devices that control electron emission from the emitter sites. The emitter sites may be formed directly on a baseplate formed of a material such as silicon or on an interlevel conductive layer (e.g., polysilicon) or interlevel insulating layer (e.g., silicon dioxide, silicon nitride) formed on the baseplate. A gate electrode structure, or grid, is typically associated with the emitter sites. The emitter sites and grid are connected to an electrical source for establishing a voltage differential to cause a Fowler-Nordheim electron emission from the emitter sites. These electrons strike a display screen having a phosphor coating. This releases the photons that illuminate the screen. A single pixel of the display screen is typically illuminated by one or several emitter sites.

In a gated FED, the grid is separated from the baseplate by an insulating layer. This insulating layer provides support for the grid and prevents the breakdown of the voltage differential between the grid and the baseplate. Individual field emission cells are sometimes referred to as vacuum microelectronic triodes. The triode elements include the cathode (field emitter site), the anode (cathodoluminescent element) and the gate (grid). U.S. Pat. No. 5,210,472 to Stephen L. Casper and Tyler A. Lowrey, entitled "Flat Panel Display In Which Low-Voltage Row and Column Address Signals Control A Much Higher Pixel Activation Voltage", describes a flat panel display that utilizes FEDs.

In flat panel displays that utilize FEDs, the quality and sharpness of an illuminated pixel site of the display screen is dependent on the precise control of the electron emission from the emitter sites that illuminate a particular pixel site. In forming a visual image, such as a number or letter, different groups of emitter sites must be cycled on or off to illuminate the appropriate pixel sites on the display screen.

To form a desired image, electron emission may be initiated in the emitter sites for certain pixel sites while the adjacent pixel sites are held in an off condition. For a sharp image, it is important that those pixel sites that are required to be isolated remain in an off condition.

One factor that may cause an emitter site to emit electrons unexpectedly is the response of semiconductor junctions in the FED to photons generated by the luminescent display screen and photons present in the environment (e.g., lights, sunshine). In an FED, P/N junctions can be used to electrically isolate each pixel site and to construct row-column drive circuitry and current regulation circuitry for the pixel operation. During operation of the FED, some of the photons generated at a display screen, as well as photons from the environment, may strike the semiconductor junctions on the substrate. This may affect the junctions by changing their electrical characteristics. In some cases, this may cause an unwanted current to pass across the junction. This is one type of junction leakage in a FED that may adversely affect the address or activation of pixel sites and cause stray emission and a degraded image quality.

One possible situation is shown in FIG. 1. FIG. 1 illustrates a pixel site 10 of a field emission display (FED) 13 and portions of adjacent pixel sites 10' on either side. The FED 13 includes a baseplate 11 having a substrate 12 formed of a material such as single crystal P-type silicon. A plurality of emitter sites 14 is formed on an N-type conductivity region 30 of the substrate 12. The P-type substrate 12 and N-type conductivity region 30 form a P/N junction. This type of junction can be combined with other circuit elements to form electrical devices, such as FETs, for activating and regulating current flow to the pixel sites 10 and 10'.

The emitter sites 14 are adapted to emit electrons 28 that are directed at a cathodoluminescent display screen 18 coated with a phosphor material 19. A gate electrode or grid 20, separated from the substrate 12 by an insulating layer 22, surrounds each emitter site 14. Support structures 24, also referred to as spacers, are located between the baseplate 11 and the display screen 18.

An electrical source 26 establishes a voltage differential between the emitter sites 14 and the grid 20 and display screen 18. The electrons 28 from activated emitter sites 14 generate the emission of photons from the phosphor material contained in a corresponding pixel site 10 of the display screen 18. To form a particular image, it may be necessary to illuminate pixel site 10 while adjacent pixel sites 10' on either side remain dark.

A problem may occur, however, when photons 32 (i.e., light) generated by a light source 33, sunlight or other environmental factors strike the semiconductor junctions formed in the substrate 12. In addition, photons 32 from an illuminated pixel site 10 may strike the junctions formed at the N-type conductivity regions 30 on the adjacent pixel sites 10'. The photons 32 are capable of passing through the spacers 24, grid 20 and insulating layer 22 of the FED 13, because often these layers are formed of materials that are translucent to most wavelengths of light. As an example, the spacers 24 may be formed of a translucent polyimide, such as kapton or silicon nitride. The insulative layer 22 may be formed of translucent silicon dioxide, silicon nitride or silicon oxynitride. The grid 20 may be formed of translucent polysilicon.

The exposure to photons from the display screen 18 and the environment may change the properties of some junctions on the substrate 12 associated with the emitter sites 14. This in turn may cause current flow and initiate electron emission from the emitter sites 14 on the adjacent pixel sites 10'. The electron emission may cause the adjacent pixel sites 10' to illuminate when a dark background may be required. This will cause a degraded or blurry image. Besides isolation and activation problems, light from the environment and display screen 18 striking junctions on the substrate 12 may cause other problems in addressing and regulating current flow to the emitter sites 14 of the FED 13.

In experiments conducted by the inventors, junction leakage currents have been measured in the laboratory as a function of different lighting conditions at the junction. At a voltage of about 50 volts and depending on the intensity of light directed at a junction, junction leakage may be on the order of picoamps (i.e., $10^{-12}$ amps) for dark conditions to microamps (i.e., $10^{-6}$ amps) for well-lit conditions. For a FED, even relatively small leakage currents (i.e., picoamps) will adversely affect the image quality. The treatise entitled "Physics of Semiconducting Devices" by S. M. Sze, copyright 1981 by John Wiley and Sons, Inc., at paragraphs 1.6.1 to 1.6.3, briefly describes the effect of photon energy on semiconductor junctions.

In the construction of screens for cathode ray tubes, screen aluminizing processes are used to form a mirror-like finish on the inside surface of the screen. This layer of aluminum reflects light towards the viewer and away from the rear of the tube. In U.S. Pat. No. 3,814,968 to Nathanson et al., a similar process is utilized in a field emitter cathode to prevent radiation emitted at the screen from being directed back onto the photocathode and emitter sites. One problem with this prior art approach is that with field emission displays (FEDs), cathode voltages are relatively low (e.g., 200 volts). However, an aluminum layer formed on the inside surface of the display screen cannot be easily penetrated by electrons emitted at these low voltages. Therefore, this approach is not entirely suitable in a FED for preventing junction leakage caused by screen and environment photon emission.

It is also known in the art to construct FEDs with circuit traces formed of an opaque material, such as chromium, that overlie the semiconductor junctions contained in the FED baseplate. As an example, U.S. Pat. No. 3,970,887 to Smith et al., describes such a structure (see FIG. 8). However, these circuit traces are constructed to conduct signals, and are not specifically adapted for isolating the semiconductor junctions from photon bombardment. Accordingly, most of the junction areas are left exposed to photon emission and the resultant junction leakage.

In view of the foregoing, there is a need in the art for improved methods for preventing junction leakage in FEDs. It is therefore an object of the present invention to provide an improved method of constructing a FED with a light blocking element that prevents photons generated in the environment and by a display screen of the FED from effecting semiconductor junctions on a baseplate of the FED. It is a still further object of the present invention to provide an improved method of constructing FEDs using an opaque layer that protects semiconductor junctions on a baseplate from light and which may also perform other circuit functions. It is a still further object of the present invention to provide a FED with improved junction leakage characteristics using techniques that are compatible with large scale semiconductor manufacture.

BRIEF SUMMARY OF THE INVENTION

In accordance with the present invention, an improved method of constructing FEDs for flat panel displays and other electronic equipment is provided. The method, generally stated, comprises the formation of a light blocking element between a cathodoluminescent display screen and baseplate of the FED. The light blocking element protects semiconductor junctions on a substrate of the FED from photons generated in the environment and by the display screen. The light blocking element may be formed as an opaque layer adapted to absorb or reflect light. In addition to protecting the semiconductor junctions from the effects of photons, the opaque layer may serve other circuit functions. The opaque layer, for example, may be patterned to form interlevel connecting lines for circuit components of the FED.

In an illustrative embodiment, the light blocking element is formed as an opaque light absorbing material deposited on a baseplate for the FED. As an example, a metal such as titanium that tends to absorb light can be deposited on the baseplate of an FED. Other suitable opaque materials include insulative light absorbing materials such as carbon black impregnated polyimide, manganese oxide and manganese dioxide. Moreover, such a light absorbing layer may be patterned to cover only the areas of the baseplate that contain semiconductor junctions. The light blocking element may also be formed of a layer of a material, such as aluminum, adapted to reflect rather than absorb light.

Other objects, advantages and capabilities of the present invention will become more apparent as the description proceeds.

DETAILED DESCRIPTION OF THE INVENTION

Figure 1:
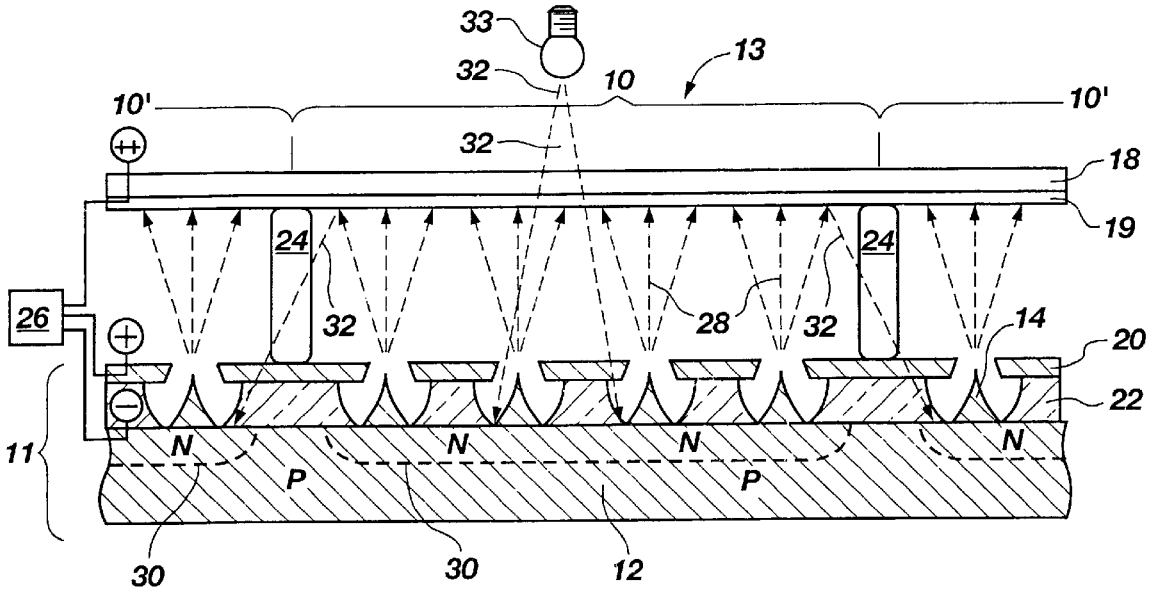
Fig. 1 (PRIOR ART)
FIG. 1 is a cross-sectional schematic view of a prior art FED showing a pixel site and portions of adjacent pixel sites.
Figure 2:
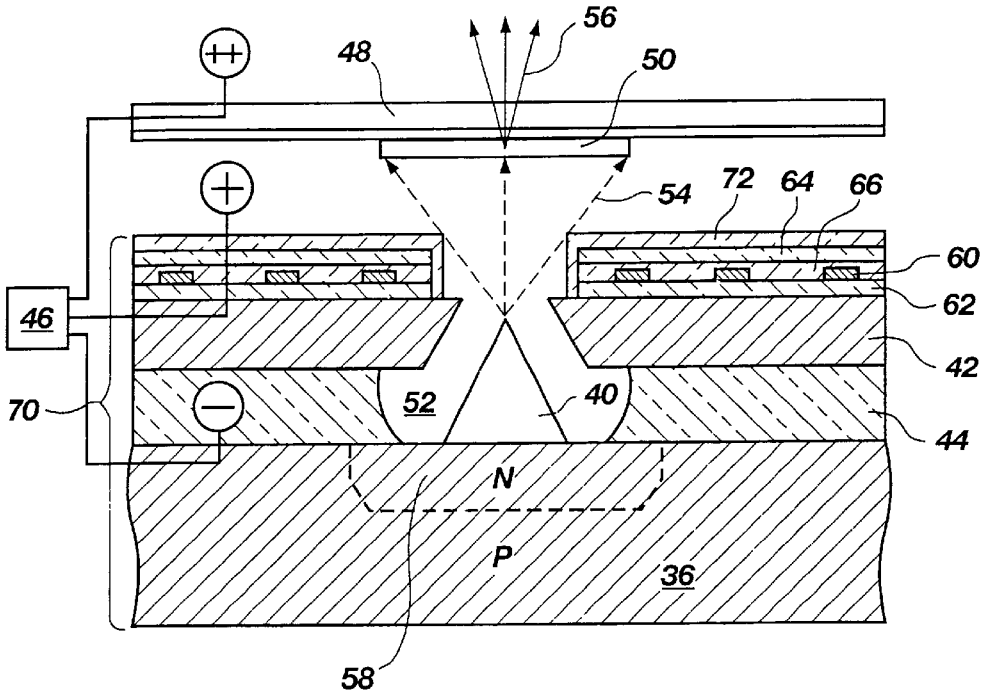
FIG. 2 is a cross-sectional schematic view of an emitter site for a FED having a light blocking element formed in accordance with the invention.

Referring now to FIG. 2, an emitter site 40 of a FED is illustrated schematically. The emitter site 40 can be formed with one or more sharpened tips as shown or with one or more sharpened cones, apexes or knife edges. The emitter site 40 is formed on a substrate 36. In the illustrative embodiment, the substrate 36 is single crystal P-type silicon. Alternately, the emitter site 40 may be formed on another substrate material or on an intermediate layer formed of a glass layer or an insulator-glass composite. In the illustrative embodiment, the emitter site 40 is formed on an N-type conductivity region 58 of the substrate 36. The N-type conductivity region may be part of a source or drain of an FET transistor that controls the emitter site 40. The N-type conductivity region 58 and P-type substrate 36 form a semiconductor P/N junction.

Surrounding the emitter site 40 is a gate structure or grid 42. The grid 42 is separated from the substrate 36 by an insulating layer 44. The insulating layer 44 includes an etched opening 52 for the emitter site 40. The grid 42 is connected to conductive lines 60 formed on an interlevel insulating layer 62. The conductive lines 60 are embedded in an insulating and/or passivation layer 66 and are used to control operation of the grid 42 or other circuit components.

A display screen 48 is aligned with the emitter site 40 and includes a phosphor coating 50 in the path of electrons 54 emitted by the emitter site 40. An electrical source 46 is connected directly or indirectly to the emitter site 40 which fumctions as a cathode. The electrical source 46 is also connected to the grid 42 and to the display screen 48 which function as an anode.

When a voltage differential is generated by the electrical source 46 between the emitter site 40, the grid 42 and the display screen 48, electrons 54 are emitted at the emitter site 40. These electrons 54 strike the phosphor coating 50 on the display screen 48. This produces the photons 56 that illuminate the display screen 48.

For all of the circuit elements described thus far, fabrication processes that are known in the art can be utilized. As an example, U.S. Pat. No. 5,186,670 to Doan et al., describes suitable processes for forming the substrate 36, emitter site 40 and grid 42.

The substrate 36 and grid 42 and their associated circuitry form the baseplate 70 of the FED. The silicon substrate 36 contains semiconductor devices that control the operation of the emitter site 40. These devices are combined to form row-column drive circuitry, current regulation circuitry, and circuitry for electrically activating or isolating the emitter site 40. As an example, the previously cited U.S. Pat. No. 5,210,472 to Casper et al., describes pairs of MOSFETs formed on a silicon substrate and connected in series to emitter sites. One of the series connected MOSFETs is gated by a signal on the row line. The other MOSFET is gated by a signal on the column line.

In accordance with the present invention, a light blocking layer 64 is formed on the baseplate 70. The light blocking layer 64 prevents light from the environment and light generated at the display screen 48 from striking semiconductor junctions, such as the junction formed by the N-type conductivity region 58, on the substrate 36. A passivation layer 72 is formed over the light blocking layer 64.

The light blocking layer 64 is formed of a material that is opaque to light. The light blocking layer 64 may be either a conductive or an insulative material. In addition, the light blocking layer 64 may be either light absorptive or light reflective. Suitable materials include metals such as titanium that tend to absorb light, or a highly reflective metal such as aluminum. Other suitable conductive materials include aluminum-copper alloys, refractory metals and refractory metal silicides. In addition, suitable insulative materials include manganese oxide, manganese dioxide or a chemical polymer such as carbon black impregnated polyimide. These insulative materials tend to absorb light and can be deposited in a relatively thick layer.

For a light blocking layer 64 formed of metal, a deposition technique such as CVD, sputtering or electron beam deposition (EBD) may be used. For a light blocking layer 64 formed of an insulative material or chemical polymer, liquid deposition and cure processes can be used to form a layer having a desired thickness.

The light blocking layer 64 may be blanket deposited to cover substantially all of the baseplate 70 or it may be patterned using a photolithography process to protect predetermined areas on the substrate 36 (i.e., areas occupied by junctions). Furthermore, the light blocking layer 64 may be constructed to serve other circuit functions as long as the area occupied by semiconductor junctions is substantially protected. As an example, the light blocking layer 64 may be patterned to function as an interlevel connector.

A process sequence for forming an emitter site 40 with the light blocking layer 64 is as follows:

1. Form electron emitter sites 40 as protuberances, tips, wedges, cones or knife edges by masking and etching the silicon substrate 36.
2. Form N-type conductivity regions 58 for the emitter sites 40 by patterning and doping a single crystal silicon substrate 36.
3. Oxidation sharpen the emitter sites 40 using a suitable oxidation process.
4. Form the insulating layer 44 by the conformal deposition of a layer of silicon dioxide. Other insulating materials such as silicon nitride and silicon oxynitride may also be used.
5. Form the grid 42 by deposition of doped polysilicon followed by chemical mechanical planarization (CMP) for self aligning the grid and emitter site 40. Such a process is detailed in U.S. Pat. No. 5,229,331 to Rolfson et al. In place of polysilicon, other conductive materials such as chromium, molybdenum and other metals may also be used.
6. Photopattem and dry etch the grid 42.
7. Form interlevel insulating layer 62 on grid 42. Form contacts through the insulating layer 62 by photopatterning and etching.
8. Form metal conductive lines 60 for grid connections and other circuitry. Form passivation layer 66.
9. Form the light blocking layer 64. For a light blocking layer formed of titanium or other metal, the light blocking layer may be deposited to a thickness of between 2000 Å to 4000 Å. Other materials may be deposited to a thickness suitable for that particular material.
10. Photopattem and dry etch the light blocking layer 64, passivation layer 66 and insulating layer 62 to open emitter and bond pad connection areas.
11. Form passivation layer 72 on light blocking layer 64.
12. Form openings through the passivation layer 72 for the emitter sites 40.
13. Etch the insulating layer 44 to open the cavity 52 for the emitter sites 40. This may be accomplished using photopatterning and wet etching. For silicon emitter sites 40 oxidation sharpened with a layer of silicon dioxide, one suitable wet etchant is diluted HF acid.
14. Continue processing to form spacers and display screen.

Thus the invention provides a method for preventing junction leakage in a FED utilizing a light blocking element formed on the baseplate of the FED. It is understood that the above process sequence is merely exemplary and may be varied, depending upon differences in the baseplate, emitter site and grid materials and their associated formation technology.

While the method of the invention has been described with reference to certain preferred embodiments, as will be apparent to those skilled in the art, certain changes and modifications can be made without departing from the scope of the invention as defined by the following claims.

All of the cited U.S. Patents and technical articles are hereby incorporated by reference as if set forth in their entirety.

What is claimed is:

1. In a field emission display having a baseplate, emitter sites, semiconductor junctions, and a display screen, a method for constructing said field emission display, said method comprising:

forming an opaque light blocking layer on the baseplate between at least one semiconductor junction of the semiconductor junctions and the display screen to block photon bombardment by at least one of the display screen, the environment of the field emission display and the display screen and the environment of the field emission display from the at least one semiconductor junction, the opaque light blocking layer comprising one of an insulative light absorbing material and a conductive light absorbing material; and preventing photons from the at least one of the display screen, the environment of the field emission display screen, and the display screen and the environment of the field emission display screen from striking the at least one semiconductor junction of the semiconductor junctions to prevent the photons from effecting the at least one semiconductor junction of the semiconductor junctions.

2. The method as recited in claim 1, wherein the opaque light blocking layer comprises a layer of material blanket deposited over the baseplate of the field emission display.

3. The method as recited in claim 1, wherein the opaque light blocking layer comprises a layer of material deposited and patterned to protect predetermined areas of the baseplate having the at least one semiconductor junction of the semiconductor junctions.

4. The method as recited in claim 1, wherein the opaque light blocking layer comprises a layer of a conductive material deposited and patterned to protect the at least one semiconductor junction of the semiconductor junctions and to conduct electrical signals within the field emission display.

5. A method for forming a field emission display having protected semiconductor junctions therein, comprising:

providing a display screen having a phosphor coating;

providing a baseplate having a plurality of semiconductor junctions;

forming a plurality of emitter sites on the baseplate electrically connected to the plurality of semiconductor junctions and connected to an electrical source, said plurality of emitter sites aligned with the display screen having the phosphor coating;

forming a conductive grid for the plurality of emitter sites, said conductive grid connected to the electrical source and separated from the baseplate by an insulating layer to establish a voltage differential to generate an electron emission from the plurality of emitter plurality of sites and photon emission from the display screen; and forming an opaque light blocking layer on the baseplate for blocking photons from contacting the plurality of semiconductor junctions to protect the plurality of semiconductor junctions from the photons from the electron emission from the emitter sites striking the display screen causing junction leakage from at least one semiconductor junction of the plurality of semiconductor junctions.

6. The method of forming a field emission display as recited in claim 5, wherein the opaque light blocking layer includes a metal layer deposited on an insulating layer formed on the baseplate.

7. The method of forming a field emission display as recited in claim 5, wherein the opaque light blocking layer includes an electrically insulating layer deposited on the baseplate.

8. The method of forming a field emission display as recited in claim 5, further comprising:

patterning the opaque light blocking layer to protect predetermined areas of the baseplate.

9. The method of forming a field emission display as recited in claim 5, wherein the opaque light blocking layer includes a material selected from the group of materials consisting of metal, a polymide impregnated with carbon black, manganese dioxide and manganese oxide.

10. A method of forming a field emission display, comprising:

forming a plurality of emitter sites having a plurality of emitter tips on a baseplate;

forming a plurality of semiconductor junctions on the baseplate with the plurality of emitter tips electrically connected to the plurality of semiconductor junctions;

forming a plurality of conductive gate elements for the plurality of emitter sites, the plurality of conductive gate elements electrically separated from the baseplate by an insulating layer, said plurality of conductive gate elements adapted establishing a voltage differential to generate an electron emission from selected emitter sites of the plurality of emitter sites when connected to an electrical source;

forming an opaque light blocking layer on the baseplate for blocking photons directed at the plurality of semiconductor junctions during use of said field emission display, said opaque light blocking layer formed as a layer of material deposited on the baseplate;

forming a display screen with a phosphor coating, said display screen spaced from the baseplate and aligned with at least one emitter site of the purality of emitter sites receiving electrons emitted by the plurality of emitter sites generating photons for lighting the display screen during use of said field emissions display; and preventing photons generated by electrons striking the phosphor coating on the display screen from contacting the plurality of semiconductor junctions to protect the plurality of semiconductor junctions from having junction leakage during use of said field emission display.

11. The method as recited in claim 10, further comprising:

patterning the opaque light blocking layer for protecting predetermined areas of the baseplate.

12. The method as recited in claim 11, wherein the opaque light blocking layer includes a light absorbing material.

13. The method as recited in claim 12, wherein the opaque light blocking layer includes a metal material.

14. The method as recited in claim 13, wherein the opaque light blocking layer includes a metal layer deposited on an insulating layer.

* * * * *

UNITED STATES PATENT AND TRADEMARK OFFICE

CERTIFICATE OF CORRECTION

PATENT NO. : 6,186,850 B1 
DATED : February 13, 2001
INVENTOR(S) : David A. Cathey, Jr. and John Lee It is certified that error appears in the above-identified patent and that said Letters Patent is hereby corrected as shown below:

Column 6,
Line 29, change “Photopattem” to -- Photopattern --

Column 7,
Line 43, before “sites” delete “plurality of”
Line 49, before “emitter” insert -- plurality of --

Column 8,
Line 12, change “polymide” to -- polyimide --

Signed and Sealed this

Twenty-third Day of December, 2003

JAMES E. ROGAN
*Director of the United States Patent and Trademark Office*